US005801138A

United States Patent [19]

Croud et al.

[11] Patent Number: 5,801,138

[45] Date of Patent: Sep. 1, 1998

[54] BLEACHING COMPOSITIONS

[75] Inventors: Vincent Brian Croud, Holywell; Stephen James Tompsett, West Yorkshire; Susan Jane Scarborough, Rhuddlan, all of Great Britain

[73] Assignee: Warwick International Group Limited, Great Britain

[21] Appl. No.: 765,648

[22] PCT Filed: Jun. 30, 1995

[86] PCT No.: PCT/GB95/01537

§ 371 Date: Apr. 21, 1997

§ 102(e) Date: Apr. 21, 1997

[87] PCT Pub. No.: WO96/01311

PCT Pub. Date: Jan. 18, 1996

[30] Foreign Application Priority Data

Jul. 1, 1994 [GB] United Kingdom ..... 9413307
Mar. 24, 1995 [GB] United Kingdom ..... 9506047

[51] Int. Cl.[6] ..... C11D 3/39

[52] U.S. Cl. ..... 510/376; 510/214; 510/303; 510/309; 510/369; 510/370; 510/375

[58] Field of Search ..... 510/375, 376

[56] References Cited

U.S. PATENT DOCUMENTS 3,816,324 6/1974 Fine et al. ..... 252/186
3,951,840 4/1976 Fujino et al. ..... 252/102
4,525,291 6/1985 Smith et al. ..... 252/95
5,180,514 1/1993 Farr et al. ..... 252/99

FOREIGN PATENT DOCUMENTS 0037184 10/1981 European Pat. Off. .
0076166 4/1983 European Pat. Off. .
0086511 8/1983 European Pat. Off. .
0294904 12/1988 European Pat. Off. .
0376704 7/1990 European Pat. Off. .
0442549 8/1991 European Pat. Off. .
0449797 10/1991 European Pat. Off. .
0468103 1/1992 European Pat. Off. .
0482274 4/1992 European Pat. Off. .
0482275 4/1992 European Pat. Off. .
2030609 4/1980 United Kingdom .
2072643 10/1981 United Kingdom .
91/09807 7/1991 WIPO .
93/13012 7/1993 WIPO .

*Primary Examiner*—Ellen M. McAvoy
*Attorney, Agent, or Firm*—Ostrolenk, Faber, Gerb & Soffen, LLP

[57] ABSTRACT

A liquid concentrate peroxide composition contains a combination of sequestrants which together are capable of universal sequestration of transition metal ions which would otherwise cause decomposition of the peroxide. The combination preferably includes a sequestrant capable of sequestering cobalt and a sequestrant capable of sequestering metal ions other than cobalt. A particularly preferred combination includes a poly(methylene phosphonic acid) and nitrogen-donor type sequestrants such as dipyridylamine or triazacyclononane.

20 Claims, No Drawings

BLEACHING COMPOSITIONS

This invention relates to liquid oxidising compositions which contain peroxide. The invention particularly relates to bleaching compositions which contain peroxide, generally being provided in the form of concentrates which can be diluted by the user to obtain a washing composition.

Aqueous peroxide-containing compositions are known and may have associated difficulties of peroxide stability. It is desirable to produce alkaline peroxide-containing aqueous liquids because the activity of the peroxide is enhanced as compared to acidic liquids. However, it is well known that alkaline conditions present greater difficulties in terms of stability than liquid acidic conditions because the peroxide tends to decompose rapidly under alkaline conditions.

Therefore, there are considerable difficulties in trying to produce a peroxide-containing composition which is sufficiently storage stable. One way of overcoming this problem is to prepare the peroxide-containing composition and use it immediately, for example as described in GB-A-2030609, so that storage stability is not required. This reference relates to protection of metal complex-based dyes or pigments when fibrous articles are bleached. The bleaching compositions therefore include chelating agents: dimethyl glyoxime and an amino carboxylic acid. The present inventors have discovered that amino carboxylic acids such as EDTA are not effective in stabilising liquid peroxide compositions.

There have however been several attempts to prepare stabilised liquid compositions which are alkaline and which contain peroxide. For example in U.S. Pat. No. 3,951,840, U.S. Pat. No. 5,180,514, GB-A-2,072,643, EP-A-0,076,166 and EP-A-0,037,184 several different methods are disclosed, all of which require the use of an alcohol.

In U.S. Pat. No. 3,951,840, a solid peroxide bleaching composition is prepared incorporating, for stability a chelating agent capable of forming a water-soluble or poorly water-soluble compound. The chelating agent is either added to the final composition or it is present during the reaction of sodium carbonate, sodium pyrophosphate or sodium borate with hydrogen peroxide to form the inorganic bleaching agent. It is reported that the presence of the sequestering agent during that reaction produced more stable peroxide adduct components.

In U.S. Pat. No. 5,180,514 aqueous peroxide bleaching compositions are described. It is described that trace metal cations in amounts of 0.5 ppm or greater result in deterioration of peroxide compositions. Stabilisation is achieved in this reference by incorporating a heavy metal sequestering agent or chelating agent and an aromatic amine free radical scavenging agent. The sequestering agents chosen are known to sequester FeIII and CuII ions. The pH of the bleach compositions is said to be in the range 1 to 8, more preferably 1 to 6 and most preferably 2 to 4. In the examples, the stabilised bleach formulations prepared are all acidic.

In GB-A-2,072,643, stability is obtained using a combination of non-aqueous solvent (ethanol), amino compounds substituted by acetate or methylene phosphonates and hydroxy alkyl diphosphonates, particularly with a polyhydroxy carboxylate, preferably gluconate or an amino acetate. The particular difficulty of preventing the hydrogen peroxide from decomposing on storage in an alkaline composition is discussed. It is specifically stated that deionised water is used to minimise peroxide decomposition.

In EP-A-0,037,184, stabilisation is achieved using a combination of an alcohol and/or a polyhydroxy carboxylate, preferably gluconate in conjunction with a phosphonate. The compositions are prepared by forming a mixture of surfactant, then adding all of the other ingredients, with the hydrogen peroxide being added last.

In EP-A-0,076,166, stabilisation is achieved using a combination of isopropanol and an aminomethylene phosphonate or hydroxyalkyl diphosphonate, optionally with a polyhydroxy aliphatic carboxylate.

In EP-A-0,482,274 and EP-A-0,482,275, a solid peroxygen source is suspended in a liquid phase comprising water and an organic solvent. The compositions also contain silicate to stabilise the peroxygen. Various sequestrants are proposed and the examples include hydroxyethylidene diphosphonic acid (REDP) and diethylenetriamine penta (methylene phosphonic acid) (DTPMP). The compositions are alkaline. All the compositions contain 8 to 14% ethanol.

In EP-A-0,468,103, a solid peroxygen source is suspended in a liquid aqueous phase and phosphonic acid sequestrants used to stabilise the composition against transition metal ion catalysed decomposition. Higher alkyl analogues of HEDP are used, optionally in combination with acrylic acid polymers having pendant hydroxy-di (phosphonic acid) methyl groups and/or DTPMP. All the compositions contain 8 to 14% ethanol.

In W091/09807, stabilisation is achieved by introducing amino poly(alkylene phosphonic acid) or a salt thereof, into a concentrated aqueous acidic solution of hydrogen peroxide, storing the mixture until the aminopoly(alkylene phosphonic acid) or salt has been converted to a derivative in the acidic solution and then diluting the concentrate with alkali to form a mildly alkaline solution.

In W093/13012, an aqueous alkaline hydrogen peroxide composition is buffered and stabilised using disodium tetra borate decahydrate and cyclohexane-1,2-diaminotetramethylenephosphonic acid. In the preparation of the composition exemplified, the phosphonic acid stabiliser was introduced into a buffered solution and shortly after, an aqueous solution containing tetradecyldimethylamine oxide, a perfume and water and then aqueous hydrogen peroxide solution were added to the stabiliser-containing mixture and finally, sodium hydroxide was added until the composition reached a pH of 8.5.

Thus, the problem of lack of stability of peroxide in aqueous alkaline compositions is well recognised and many methods have been described for trying to confer storage stability on such compositions. As will be seen from the above, these include the incorporation of non-aqueous solvents, sequestering agents, free-radical scavengers, the use of deionised water in the production or rendering the pH acidic.

Whilst it is recognised that the prior art may improve the stability of hydrogen peroxide-containing compositions, the gain in stability resulting from the prior art disclosures is short term only. There is therefore, still a need for an improved one-pack peroxide-containing aqueous oxidising composition, and particularly for an aqueous alkaline oxidising composition which will maintain sufficient stability to have a useful shelf-life.

Having studied the decomposition of peroxide in aqueous solution in detail, the present inventors have found that although decomposition due to the presence of iron, copper and manganese ions is a problem, peroxide decomposition due to the presence of cobalt ion is particularly problematic. Furthermore, under alkaline conditions, conventionally used sequestering agents do not provide effective sequestration of all of the transition metal ions. It has been found that cobalt in the presence of other transition metal ions is particularly problematic.

Catalytic effects of transition metals, for instance, in the decomposition of peroxide bleaches may depend upon the transition metal cycling between oxidation states, including via unstable oxidation states, or may be catalysed by the ion in one oxidation state but not another. The inventors believe that these effects might be reduced if the metal ions are held in a single stable (non-catalytically active) oxidation state, for instance by the use of a sequestering agent which can complex the metal ion in that oxidation state strongly but which does not form such a stable complex with the metal ion in the unstable oxidation state. The stable complex should furthermore not allow peroxide anion to become associated and polarised to lead to the oxygen-oxygen bond being broken. This is minimised either by there being no vacant binding sites for ligands around the metal ion, the ligands of the sequestrant molecule being non-labile (eg due to lack of flexibility of the molecule) or the charge density around the metal centre is such that the polarisation of the bond does not take place.

Without wishing to be bound by theory, it is believed that the particular difficulties imposed by the presence of cobalt is due to the presence of catalytically active CoIV ions. Although sequestrants may complex cobalt ions in various oxidation states, it is believed that they do not form adequately stable complexes which are not catalytically active. CoIII favours octahedral complexing but existing sequestrants do not form non-labile complexes. CoII ions form tetrahedral complexes and the sequestering agents used in the prior art systems do not provide effective sequestration of such metal ions which form (tetrahedral) complexes with four coordination sites. Nor, it is believed, do the conventional sequestrants have ligands which favour complexation with cobalt ions.

Furthermore, it has also been found that even when complexed, some transition metal ions are still active in decomposing hydrogen peroxide. Therefore, the addition of any sequestering agent does not necessarily result in successful stabilisation. Even if a number of sequestering agents are used which theoretically should enable stable complexes to be formed from all of the transition metal ions present, it has been found that considerable active oxygen loss occurs from peroxide-containing compositions.

The inventors have found that a combination of sequestering agents must be used, and that the combination must be specifically chosen so that the most stable metal complexes which are inevitably formed at equilibrium conditions with the respective metal ions present in the composition, are not catalytically active in peroxide decomposition. For a sequestrant to be effective, therefore, it must be able to form the most catalytically inert complex in the presence of competing ligands.

If all of the sequestering agents are added simultaneously, initially the fastest reaction occurs and the complexes formed do not necessarily provide maximum stability and it may be some time before the most stable complexes form. However, we have found that careful selection of combinations of sequestering agents and their order of addition to components of the concentrate which potentially contain transition metal ions or else allowing the sequestrant to contact such components for a time to allow equilibrium complexation to be reached overcomes these problems to provide peroxide-containing compositions which have sufficient stability to provide a useful shelf life and which provide a considerable improvement over the known peroxide-containing compositions.

Although combinations of sequestrants of different types have been used in detergent compositions previously, for instance in EP-A-0,085,511, EP-A-0,294,904 and EP-A-0,442,549, none of the combinations disclosed have adequate stabilising performance.

Therefore, in accordance with the present invention there is provided an oxidising liquid concentrate composition comprising peroxide and a combination of sequestering agents in an amount which is at least stoichiometric to fully complex all of the transition metal ions, the composition having a positive result in test A.

There is also provided in the invention a method for making the concentrate liquid by sequential or simultaneous addition of the sequestering agents to other components of the composition.

There is also provided in the invention the use of the concentrate to form an oxidising liquor by dilution with water and the dilute oxidising liquor produced by such dilution. The concentrate is a liquid (by which we include gel-form and cream or foam-form compositions as well as pourable liquids), and most preferably is aqueous although it may contain other liquid vehicles in addition to water or be substantially water free.

Test A

A freshly prepared (less than 24 hours old) stock aqueous solution comprising cobalt II, iron III, manganese II and copper II ions in the ratio 1:1:1:1, each at a concentration of 5 mM is prepared using ultra pure reagents (to avoid interference by impurity ions). The solution must be used within 24 hours of preparation, preferably within 12 or 6 hours of preparation, as over time the iron precipitates out of solution as hydrated iron III oxide. Two sequestering agents under test are added to a portion of the solution sequentially, a time delay of 5 minutes being allowed between the addition of the two sequestering agents, the quantity of each of the individual sequestering agents being in excess of the stoichiometric amount to fully complex all of the transition metal ions (assuming octahedral complexes formed, ie as in the screen—4 equivalents of bi-dentate ligands and 3 equivalents of tri-dentate ligands). After a further time delay of 30 minutes, a predetermined quantity of this aqueous solution comprising sequestered metal ions is which will produce a total transition metal concentration in the peroxide solution of 0.4 mM) is added to 50 ml 6% w/v hydrogen peroxide solution having sodium hydroxide added to bring the pH to 10 (corresponding roughly to the composition of the invention).

After adding the solution comprising sequestered transition metal ions, the pH of the solution is measured to ensure that it has not changed due to the addition of the solution comprising sequestered transition metal ions. If the pH has changed more than 0.2 pH units, the pH is readjusted back to 10 with the addition of dilute HCl or sodium hydroxide solution.

The initial peroxide concentration is immediately determined using iodometric titration of an aliquot. The solution is then left standing for 3 days (72 hours) in conditions of ambient temperature and pressure 20° C., 1 atmosphere) during which time (after 1, 5, 24, 30, 48 and 72 hours), an iodometric titration is carried out on a further aliquot to determine the peroxide concentration.

A control test is carried out using a sample of the stock transition metal ion solution and sequestering this with a stoichiometric amount of Dequest 2066 (diethylene triamine penta (methylene phosphonate) sodium salt) (Dequest is a trade mark of Monsanto) added in one shot in place of the pair of sequestering agents under test.

Combinations of sequestering agents which are suitable for use in the present invention are those which, under the conditions of this test, have as good as or better results than the control in terms of 3 day loss of peroxide activity. Preferably the results are at least 20%, more preferably at least 40% and most preferably at least 50% better than the control, often at least 100% better.

Preferably, for a combination of two sequestering agents, test A will be repeated to test the results obtained for the addition of the sequestering agents in the reverse order of addition. For use in the concentrates of the present invention, the sequestering agents are therefore, preferably added to the concentrate in the order of addition which provides the lowest peroxide loss over 3 days in test A.

Preferably, the combination of sequestering agents for use in the concentrates of the present invention also produce a pass in test B as described below. Test B is to determine the long term stability of the sequestrant system under realistic test conditions for a commercial product. This cannot be determined by test A due to the short time duration. This also gives a method for identifying any problems with high levels of sequestrant compared to the transition metal loading. Therefore, materials which pass test A may fail test B due to oxidative, hydrolytic or perhydrolytic instability or increased competition between unbound sequestrant molecules. The test should be performed on more than one occasion to check the reproducibility of the sequestrant system. If a system is ever markedly worse than the control, then this combination of sequestrants is not suitable for use in a commercial product.

Test B

A 22% active surfactant mixture comprising linear alkyl benzene sulphonate and ethoxylated alcohol *Marlon AS3 (trade mark) (and *Synperonic A7 (trade mark) (90% active) from ICI) from Huls, respectively in a weight ratio 7:4 is prepared. The mixture is prepared by firstly adding LABS to water at 45° C., stirring to dissolve and then adding the alcohol ethoxylate. After dissolution of the alcohol ethoxylate, 50% w/w sodium hydroxide solution containing 0.5% w/w *Dequest 2066 is added to bring the pH to 9. The sample liquid produced is then allowed to cool and then the two (or more) sequestering agents under test are then added sequentially with a 15 minute delay between each addition.

The sample liquid is allowed to stand overnight at ambient temperature and pressure in a darkened cupboard and 60% w/v hydrogen peroxide is then slowly added to the sample with vigourous stirring to produce a 5% w/w solution. The pH is readjusted if necessary to the desired pH with 50% w/w sodium hydroxide containing 0.5% Dequest 2066. The resulting test sample is tested for initial peroxide concentration by permanganate titration and then stored at 25° C. for 12 weeks in a storage container which is sealed with Nescofilm (trade mark) to prevent evaporation loss of water (which would otherwise result in a false increase in the concentration of peroxide (which is non-volatile) in the sample being recorded. After periods of 6 weeks and 12 weeks storage, a further permanganate titration is carried out and the pH is determined.

The test is carried out using varying amounts of each of two sequestering agents. The total sequestrant levels are preferably less than 1.5% in total, preferably in the range 0.2 to 1.0% by weight. The most appropriate amounts which are those which produce maximum peroxide stability, depend upon the transition metal ion impurities and their levels in the various components which are used to make up the test sample. However, the effective concentrations of sequestering agent can readily be determined by trial and error.

Preferred combinations and respective amounts of sequestering agents for use in the present invention ensure that no greater than 20% initial peroxide is lost after 12 weeks following Test B, more preferably no greater than 15%, or 12% or most preferably no greater than 10% of the initial peroxide is lost after 12 weeks storage in accordance with Test B.

The choice of the combination of sequestrants for use in the invention may be initiated using a screening test. In this test, a quantity of sequestrant under test is added to each of four 20 mM solutions each of one transition metal ions selected from copperII, manganeseII, cobaltII and ironIII. The amount of sequestrant is in excess of the amount to complex completely the metal ion assuming an octahedral complex is formed. Thus for a bidentate ligand, four equivalents are added and for a tridentate ligand, three equivalents are added. The mixture is left for a period to equilibrate and an aliquot is then added to hydrogen peroxide at pH 10. A sample of the solution is immediately removed and the initial peroxide content determined by a suitable titration method (iodometric or permanganate). The peroxide content is monitored over a period of up to 3 days or longer. The more rapid the loss of peroxide, the worse the sequestrant in terms of stabilising performance for that metal.

The combination of sequestrants is such that weaknesses in stabilising performance of one sequestrant shown by the screen are compensated by the other(s). Since most conventional sequestrants used to sequester transition metals to stabilise liquid bleaches have reasonably good activity on iron, copper and manganese, it is the weakness in cobalt sequestration revealed by this screen which is compensated by addition of a sequestrant with good cobalt sequestration performance.

The screen may predict combinations of sequestrants, which when used together do not have the required universality of action on a mixture of the transition metals. For instance the complexes formed at equilibrium may be catalytically active, whereas without the competition from the sequestrants/metal ions, the complexes formed are non-catalytic. Test A is used to screen sequestrant combinations which have a universal activity on a mixed transition metal system.

The combination of sequestering agents which will provide effective sequestration of each of the transition metal ions which catalyse peroxide decomposition, will be a combination of sequestering agents in effective amounts which produce a successful result in test A.

Particularly preferred combinations which give good results in test B and are consequently useful in the invention comprise sodium diethylene triamine penta(methylene phosphonate) such as is sold as Dequest 2066 by Monsanto (and referred to hereinafter as D2066) and 2,2'-dipyridylamine (hereinafter referred to as DPA) and D2066 and 1,2-diaminocyclohexyl tetra (methylene phosphonic acid) (hereinafter referred to as DACH).

The combination of sequestering agents as explained above gives a universal sequestering performance on the screen of transition metal ions. In general these can be separated into two groups, since cobalt tends to be the ion which is most difficult to sequester.

The Group A sequestering agent preferably comprises one or a mixture of more than one sequestering agents which is effective for stabilising peroxide against decomposition by cobalt II ions under alkaline conditions. They may also be effective for sequestering the other transition metal ions. The Group B sequestering agent comprises one or a mixture of more than one sequestering agent which is effective for stabilising peroxide against iron, copper or manganese under alkaline conditions but substantially ineffective in stabilising peroxide against decomposition by cobalt.

The Group A sequestering agent is preferably selected from compounds having nitrogen donors as ligands, such as triazacycloalkane compounds especially 1,4,7-triazacyclononanes (TACNs), or dipyridylamine (DPA), as well as some phosphonate compounds wherein the molecule has limited flexibility and appropriate spacing of the ligands such as 1,2-diaminocyclohexyl tetra (methylene phosphonic acid) and salts thereof (DACH). DACH and/or DPA are particularly preferred. Group B sequestering agent is preferably a non-cyclic alkylene amino poly(methylene phosphonic acid) or other phosphonic acid compound or salt thereof, especially the following agents under the tradename Dequest: such as Dequest 2006 (aminotri(methylene phosphonic acid) sodium salt; ethylene diamine tetra (methylene phosphonic acid) or the sodium or potassium salt (eg Dequest 2046 which is the sodium salt) and diethylenetriaminepenta (methylene phosphonic acid) (Dequest 2060) or 1-hydroxyethane-1,1-diphosphonic acid sold as Dequest 2010 (hereinafter referred to as D2010) or analogues with higher alkylidene groups. D2066 is particularly preferred. Other Group B useful sequestering agents are those sold under the tradename Briquest from Albright & Wilson.

The concentrate composition is preferably ethanol-free, more preferably free of all volatile monohydric alcohols (ie having flash point about the same as or lower than isopropyl alcohol). Preferably the concentrate composition is alkaline. Preferably, the composition will have a pH of at least 8, preferably at least 8.5 or even at least 9 or 9.5.

Since the sequestering agents sequester the transition metal ions so that they are no longer catalytic in peroxygen decomposition i.e. to form stable complexes with the transition metal ions which do not cause peroxide decomposition, the stability of the peroxide-containing compositions is significantly improved.

The amount of the Group B sequestering agent to be incorporated into the oxidising composition of the invention is at least 0.005% by weight, preferably at least 0.01% by weight. Generally, it will be no greater than 2% by weight, preferably no greater than 1% by weight and most preferably no greater than 0.5% by weight of the total composition.

The amount of the Group A sequestering agent to be incorporated into the oxidising composition of the invention is at least 0.005% by weight, preferably at least 0.01% by weight, preferably no greater than 2% by weight or no greater than 1% by weight or, more particularly from 0.02 to 0.6% by weight.

Further optional sequestering agents may also be incorporated in the oxidising composition. Where present, such further optional sequestering agents are preferably added in amounts of at least 0.0005% by weight, preferably no greater than 2% by weight, more particularly in the range of from 0.01% to 1.0%, most preferably in the range from 0.02 to 0.6%, by weight.

In preparing the oxidising composition of the invention, the Group A and Group B sequestering agents may be added at the same time or sequentially to other components of the composition. The sequestering agents may be added to one another to form a pre-mix solution prior to contact with the peroxide. Preferably they are mixed with sufficient alkali to form an alkaline solution, then the peroxide is subsequently added. Where they are added sequentially to alkali or to peroxide solution, there may be a time delay between adding the two sequestering agents, for example of at least 5 minutes, preferably at least 10 minutes. Generally, the Group B sequestering agent will be added first where the two are added sequentially.

The invention also includes a method for preparing an oxidising composition in which most or all of the components of the composition other than the peroxide solution including at least one of and preferably both of the Group A and Group B sequestering agents are mixed and then the peroxide is added. Thus, the invention also includes a method for preparing a composition comprising forming a pre-mixture comprising a Group A sequestering agent and a Group B sequestering agent in the desired final amounts and subsequently the peroxide is added to that pre-mixture. Preferably, the pre-mixture comprising the at least one Group A sequestering agent and the at least one Group B sequestering agent is alkaline prior to addition of the peroxide. Preferably the pre-mixture will have a pH above 7.5, or above pH 8, more preferably above pH 9. The pH should generally be below 10. A suitable pH is about 9.5.

In a particularly preferred embodiment of the invention, all of the components of the oxidising composition other than sequestering agents and peroxide are mixed to form a pre-mix. The respective sequestering agents are then added in an amount of at least 0.01% by weight first sequestering agent and at least 0.01% by weight second sequestering agent, the total amount of sequestering agent being no greater than 1% by weight and the pH of the composition is adjusted if necessary to a pH of from 7.5 to 10, preferably about 9.5, and the peroxide is subsequently added. Final pH adjustment of the oxidising composition may be required to restore alkalinity, preferably using alkali containing sequestering agent.

The present invention also includes a pretreatment method for preparing an aqueous oxidising-concentrate in which components comprising an aqueous liquor and other optional components are mixed with peroxide, characterised in that prior to mixing with the peroxide, every component of the mixture having a transition metal ion content such that in the oxidising composition it will produce an AvOx (available oxygen from peroxide) loss of 50% or more, or even 25% or more, or most preferably every component which will produce an AvOx loss of 5% or more from the oxidising composition over 12 weeks at 37° C. and 80% relative humidity (RH) is pre-treated in a pre-treatment step by contact in an aqueous liquid with the sequestering agents combination used in the present invention. Preferably the pre-treatment step will be as described in British patent application number 9413307.1 and repeated in WO 96/01309.

The present invention has the additional advantage that it enables preparation of stable compositions which do not require incorporation of an additional, non-aqueous water miscible solvent such as an alcohol. Monohydric alcohols and other alcohols with flash point the same as or lower than isopropyl alcohol are disadvantageous because of their toxicity because low flash points involve hazards during manufacture and because they reduce the flash-point of the compositions of the invention themselves. This latter disadvantage is a particular problem due to the strongly oxidising (and therefore potentially explosive) nature of peroxides. In addition, monohydric alcohols are disadvantageous because their use increases processing costs and can limit formulation options and/or application options. The use of glycols can be advantageous for some applications and does not involve the disadvantages inherent in the use of monohydric alcohols.

The present invention may also be of value in preparing non-aqueous liquid compositions and/or in which the pretreatment step is carried out in a non-aqueous solvent with the products subsequently being incorporated into an aqueous liquid concentrate composition.

The peroxide may be one or mixtures of more than one of hydrogen peroxide, organic peroxides and inorganic persalts which liberate hydrogen peroxide in water. Suitable examples of inorganic persalts include alkali metal salts of perborate, persulfate, perphosphate or percarbonate. This invention has been found to be particularly advantageous because it enables the use of hydrogen peroxide to form liquid concentrate compositions. As hydrogen peroxide is a liquid under normal conditions of use, it is a particularly easily decomposed form of peroxide and is therefore particularly problematic. Hydrogen peroxide is particularly preferred as it has a higher rate of reaction in use, because it does not require dissolution time. Pre-formed peracids may also be used as the peroxide component. Examples are perbenzoic or peracetic acid. A pre-formed peracid may be used in addition to a peroxide salt or hydrogen peroxide and if so, the peracid may be encapsulated. Solid peroxide compounds may be dissolved or suspended (in which case at least some will be dissolved) in the liquid composition.

The concentration of peroxide in the final concentrate composition will generally be such as to provide a concentration equivalent to hydrogen peroxide (100%) in an amount of at least 0.5% preferably at least 1%, most preferably at least 3%. Generally it will be no greater than 15%, preferably below 10% and most preferably below 7% by weight of the oxidising composition. The aqueous liquor and alkali for preparing the aqueous alkaline concentrate composition may be provided in the form of an aqueous solution of alkali or may be introduced separately as water and alkali components.

Where the oxidising concentrate compositions are alkaline, alkalinity in the compositions of the present invention is generally provided by the addition of any conventional alkali. In particular hydroxides, especially alkali metal hydroxides are used. The amount of alkali used is such that the pH of the final concentrate composition will be at least 7, and generally being no greater than 13.5. Preferably, the pH of the final composition will be at least 8, or even at least 8.5. Preferably the pH of the final composition will be up to around pH 11, and most preferably from pH 9 to 10.5. If the pH is adjusted after the peroxide addition, the alkali used is preferably pretreated with sequestrant, for example as described in the aforementioned co-pending application 9413307.1.

The method according to the present invention may be used to prepare an oxidising composition for any application.

Other optional components which may be incorporated in the compositions for preparing the oxidising concentrate composition may comprise any of the typical additives used in oxidising, especially detergent compositions, for example surfactants, builders, bleach activators, electrolytes, hydrotropes, decoupling polymers, optical brighteners, dyes, fragrances, anti-redeposition agents, dye-transfer inhibitors, enzymes and/or free radical scavengers and/or additional peroxide stabilisers. Buffers may also be included.

Oxidatively, perhydrolytically or hydrolytically unstable materials if incorporated into the oxidising composition are preferably suitably protected, for example by releasable encapsulation, prior to incorporation.

Generally the oxidising concentrates compositions of the present invention will be bleaching compositions ie dilutable with water to form bleaching liquors, for instance for hard surface or fabric and fibre bleaching eg in laundry uses. The concentrates may contain at least one surfactant.

The surfactant may be anionic, nonionic or cationic or mixtures of such surfactants. The incorporation of anionic surfactants has been found to cause the most difficulties with respect to rate of decomposition of peroxide in an alkaline peroxide composition. In the present invention, one of the particular advantages which have been found is that anionic surfactants can be incorporated into the oxidising compositions while surprisingly, maintaining good stability of the peroxide composition.

Suitable anionic surfactants include any surfactant useful in a detergent for example salts of sulphonic or monoesterified sulphuric acids such as alkyl benzene sulphonate, alkyl sulphates, alkyl ether sulphates, olefin sulphonates, alkyl phenol sulphates, alkyl phenol ether sulphates, alkyl ethanolamine sulphate, alkyl ethanolamine ether sulphates, alpha sulpho fatty acids or esters, each having at least one alkyl or alkenyl group from 8 to 22, more usually 10 to 20 aliphatic carbon atom and the alkyl or alkenyl groups preferably being straight chain primary groups. Other suitable anionic surfactants include fatty alkyl sulphosuccinates, fatty alkyl ether sulphosuccinates, acyl sarcosinates, acyl taurides, and paraffin sulphonates. The preferred anionic surfactants are salts of alkali metals or alkaline earth metals, preferably sodium. Other salts include ammonium, monoethanolamine, diethanolamine, triethanolamine and alkyl amines having up to 7 aliphatic carbon atoms. Particularly preferred examples of anionic surfactants for use in the present invention include sodium dodecylbenzene sulphonate, potassium hexadecylbenzene sulphonate, lauryl ether sulphate and paraffin sulphonates.

Suitable nonionic surfactants include for example alkanolamides (such as C10 to C20) and/or ethoxylated alcohols, carboxylic acids, amines, alcohol amides, alcohol phenol, glyceryl esters, sorbitan esters, phosphate esters etc.

Suitable cationic surfactants include for example quaternary amines, imidizolines and quaternised imidizolines. Amphoteric surfactants may also be used.

All of the percentages given below are by weight as a percentage of the total weight of the oxidising concentrate composition. Surfactants are generally incorporated into the composition of the present invention in amounts of at least 1%, or even at least 5%, preferably at least 10% by weight of the finished oxidising composition. Preferably the amount of surfactant in the composition will be up to 60% by weight and most preferably up to 50% by weight.

Typically the concentrate composition will be a heavy-duty laundry detergent composition containing a high proportion of active components, including at least 10% by weight surfactant, preferably at least 15% or even at least 25%. The formulation may therefore be for example either isotropic or structured. Structured compositions may include decoupling polymers, optionally with electrolyte and isotropic compositions may include hydrotrope optionally with electrolyte. The optional, other components of the concentrate composition are therefore selected according to the desired formulation.

Any builder which is conventional for use in detergent compositions may be used in the compositions of the present invention such as phosphates, carbonates, zeolites, acetates, citrates, metaphosphate, pyrophosphate, phosphonate, EDTA and/or polycarboxylates or silicates. The builder may also contribute to the electrolyte concentration in the composition. Builders such as silicates may also contribute to the alkalinity of the compositions of the present invention. A preferred builder is an alkali metal citrate salt.

Certain builders may interfere with the sequestration of transition metal ions by the sequestering agents thereby decreasing the stability of the formulations, for example zeolites, phosphates, EDTA, polycarboxylates and/or phosphonates. If, for performance reasons, these are preferred components they are preferably included in a form such as to prevent this interference but still in a form which can be released into the wash bath, preferably by encapsulation. If the same compound is being used as the sequestrant of the invention, an excess over the amount for that function may be incorporated as a builder or auxiliary therefor.

Builders may be incorporated in the composition in amounts of from 0 to 40% by weight of the total composition, preferably at least 2%, most preferably at least 5%, generally no greater than 30% and preferably no greater than 25% by weight of the final composition.

Bleach activators may be used in the composition. Any of the N-acyl or O-acyl compounds which are conventionally used as bleach activators is suitable. The compound may be an anhydride, but is preferably an ester or, even more preferably, an amide derivative. The activators used may be added as a mixture for example one which produces a hydrophobic peracid and one which forms a hydrophilic peracid.

Amide derivatives include acyl imidazolides and N,N-di acylamides, such as TAED.

Generally the activator, if any, will be incorporated in amounts of from 0.1% to 10%, preferably in amounts greater than 0.5% or even 1%. Generally the amount of activator will be no greater than 5%, or even 2.5% by weight of the final composition.

Bleaching catalysts or enzymatic activators may also be used in the compositions of the present invention. These are generally required at lower concentrations than the N-acyl or O-acyl activators.

One or more of the optional components may be unstable under aqueous alkaline conditions or react with peroxide under aqueous alkaline conditions. This may be a particular problem for builders and/or activators and in some cases it may be advantageous to encapsulate one or more of the optional components for inclusion in the aqueous composition. A suitable encapsulation technique for activators and suitable activators are described in for example British patent application number 9323634.7 and repeated in WO 95/14077.

The electrolytes which may be used are any electrolytes commonly used in this type of composition either singly or mixtures of more than one electrolyte, and in amounts necessary to provide the desired degree of physical stability or viscosity to the composition. Likewise, the hydrotropes and decoupling polymers which are used are conventional (except that ethanol is preferably not used for such a function) and in the desired amounts for physical stability. Optionally, thickening agents may also be incorporated in the composition as an additional optional component.

Any of the above components may be in the solid form, suspended in the aqueous liquid of the concentrate composition. However, preferably all of the components are in the form of liquids, most preferably as aqueous solutions. As explained above, some components may react with peroxide or be unstable in alkaline conditions. These are preferably incorporated as encapsulated solid materials into the concentrate composition.

The oxidising concentrate compositions of this invention may be categorised in two convenient categories.

The first category comprises liquid formulations which include a surfactant. These compositions will be suitable for use as hard surface cleaners and other uses where surface active disinfection and/or bleaching is required, for instance floor cleaning compositions, laundry detergents and textile treatment compositions, domestic and institutional hard surface cleaners, toilet disinfectants, general toiletries disinfectant, sanitising bottles, including glass and plastic bottles, and pipe cleaning compositions. For most of these uses, it will be desirable for the composition to be relatively low foaming, although for some, for instance toilet disinfecting and general toiletries disinfectant, it may be desirable for the composition to have a relatively high foam. The use of suitable surfactants which will foam is well known in the art. For compositions which are desired to be low foam, it may desirable to incorporate anti-foaming agents, for instance soap or silicone anti-foams. Liquid formulations including surfactants may be useful in other applications such as for use to bleach fibres or fabrics, such as nappies or in fabric production, cellulose fibres, especially in paper de-inking operations, and in general environmental clean-up operations.

The second category of composition comprises liquid formulations but which contain no surfactants. These may be useful where no surface activity is necessary, for instance in effluent and water treatment, in toilet disinfectants, for use as a swimming pool treatment, for colour removal from chemicals, from pulp during paper making or recycling, in general industrial sterilisation and in some domestic sterilisation situations, for instance as a general toiletry disinfectant, in denture cleaning compositions, in sanitising glass and plastic bottles or other containers, as well as in certain environmental clean-up operations. Furthermore, where the composition is to be used as a general industrial oxidation reaction, it may be undesirable to include a surfactant.

The liquid formulations mentioned above may be pourable liquids, which are aqueous or non-aqueous, or may be in gel or paste form. Furthermore the formulations may be two-phase, for instance a cream form. Alternatively, the formulations could be in the form of a mousse (where the composition contains surfactant) by the injection of a gas, especially for domestic hard surface cleaning operations.

The following examples illustrate the invention.

EXAMPLE 1

Results obtained using Test A (described above).

TABLE 1

| Example | Sequestrant First/Second | Titre/ml Initial | Titre/ml 3 Days | % AvOx remaining after 3 days | % improvement in AvOx remaining cf control |
|---|---|---|---|---|---|
| 1.1 | D2066/DPA | 34.0 | 23.4 | 68.8% | 112 |
| 1.2 | D2066/D2046 | 33.0 | 15.7 | 47.6% | 47 |
| 1.3 | D2066/DACH | 33.7 | 22.8 | 67.7% | 109 |
| 1.4 | D2066/D2006 | 32.9 | 9.8 | 29.8% | −8 |
| 1.5 | D2066/D2010 | 33.8 | 15.2 | 45.0% | 39 |
| 1.6 | D2066/GLUC | 33.5 | 4.8 | 14.3 | −56 |
| 1.7 | D2066 (control) | 33.0 | 10.7 | 32.4% | — |

Gluc is sodium gluconate.

The quantities used are as described in the description of Test A above.

EXAMPLE 2 (Test B)

An example was made up as follows using 22% active surfactant using a ratio of LABS: 7EO of 7:4. In order to prepare the samples, firstly LABS was added to water at 45° C., stirred to dissolve and then the alcohol ethoxylate (7EO) was added. Once the 7EO dissolved, the LABS was neutralised by adding 50% w/w sodium hydroxide. The mixture was allowed to cool and the sequestrant combinations (details of type and amount of which are given in Table 2 below) were then added to a sample surfactant solution sequentially, D2066 first, and mixed in thoroughly.

Four series of tests were carried out using different batches of the surfactants. In each series, an inventive combination of D2066 and DPA was used so that a comparison against the other test combinations could be made. Also this allowed the reliability of the preferred combination on different surfactant batches to be assessed.

TABLE 2

| Formulation | Amount by Weight (%) in Surfactant Solution | | | | | |
|---|---|---|---|---|---|---|
| | Dequest 2066 | DACH | DPA | Dequest 2006 | Dequest 2046 | Dequest 2010 |
| 2.1.1 | 0.5 | — | 0.03 | — | — | — |
| 2.1.2 | 0.5 | 0.05 | — | — | — | — |
| 2.1.3 | 0.5 | 0.1 | — | — | — | — |
| 2.1.4 | 0.5 | 0.2 | — | — | — | — |
| 2.1.5 | — | 0.05 | — | — | — | — |
| 2.1.6 | — | 0.1 | — | — | — | — |
| 2.1.7 | — | 0.2 | — | — | — | — |
| 2.2.1 | 0.5 | — | 0.03 | — | — | — |
| 2.2.2 | 0.5 | — | — | 0.05 | — | — |
| 2.2.3 | 0.5 | — | — | 0.1 | — | — |
| 2.2.4 | 0.5 | — | — | 0.2 | — | — |
| 2.2.5 | — | — | — | 0.05 | — | — |
| 2.2.6 | — | — | — | 0.1 | — | — |
| 2.2.7 | — | — | — | 0.2 | — | — |
| 2.3.1 | 0.5 | — | 0.03 | — | — | — |
| 2.3.2 | 0.5 | — | — | — | 0.05 | — |
| 2.3.3 | 0.5 | — | — | — | 0.1 | — |
| 2.3.4 | 0.5 | — | — | — | 0.2 | — |
| 2.3.5 | — | — | — | — | 0.2 | — |
| 2.4.1 | 0.5 | — | 0.03 | — | — | — |
| 2.4.2 | 0.5 | — | — | — | — | 0.05 |
| 2.4.3 | 0.5 | — | — | — | — | 0.1 |
| 2.4.4 | 0.5 | — | — | — | — | 0.2 |
| 2.4.5 | — | — | — | — | — | 0.2 |

The pH was adjusted to 9–9.5 using more 50% sodium hydroxide solution. 60% w/v hydrogen peroxide was then added to produce a 5% w/w solution. The pH was then adjusted using 50% w/w sodium hydroxide solution which has been pre-sequestered by addition of 0.5% D2066. Samples were analysed for initial available oxygen (AvOx) by permanganate titration. The compositions were stored for twelve weeks at ambient conditions (approximately 25° C. and 1 atmosphere) and the AvOx determined again using the permanganate titration. The % loss from the initial value is given in Table 3 and the final pH.

It can be seen that good results are obtained using mixtures of DPA, or DACH with Dequest 2066. The repeated tests on DPA and D2066 show very good and reproducible results. In another series of tests in which these combinations of sequestrants were tested again, the D2066/DPA combination showed reliably good results, whereas a combination of D2066 and D2010 (HEDP) had worse results than those indicated in Table 3.

TABLE 3

| Formulation | % loss of peroxide | pH |
|---|---|---|
| 2.1.1 | 10.18 | 9.53 |
| 2.1.2 | 15.61 | 9.54 |
| 2.1.3 | 17.17 | 9.59 |
| 2.1.4 | 18.72 | 9.49 |
| 2.1.5 | 42.74 | 9.89 |
| 2.1.6 | 47.38 | 9.66 |
| 2.1.7 | 22.31 | 9.35 |
| 2.2.1 | 10.81 | 9.33 |
| 2.2.2 | 19.84 | 9.43 |
| 2.2.3 | 21.67 | 9.48 |

TABLE 3-continued

| Formulation | % loss of peroxide | pH |
|---|---|---|
| 2.2.4 | 24.69 | 9.63 |
| 2.2.5 | 88.87 | 10.68 |
| 2.2.6 | 92.05 | 10.38 |
| 2.2.7 | 92.84 | 10.96 |
| 2.3.1 | 9.42 | 9.62 |
| 2.3.2 | 14.43 | 9.13 |
| 2.3.3 | 14.86 | 9.59 |
| 2.3.4 | 18.52 | 9.40 |
| 2.3.5 | 24.45 | 9.48 |
| 2.4.1 | 10.02 | 9.28 |
| 2.4.2 | 13.0 | 9.26 |
| 2.4.3 | 11.42 | 9.29 |
| 2.4.4 | 14.08 | 9.27 |
| 2.4.5 | 35.66 | 9.51 |

EXAMPLE 3

Examples were carried out using formulations based on secondary alkane sulfonate (SAS). Formulations were made up using a surfactant base comprising SAS anionic surfactant with 7EO as nonionic surfactant. The total amount of surfactant used was 18.75% active and the composition contained 15% SAS and 3.75% 7EO.

Firstly, the SAS was dissolved in water at 40° C. and the 7EO was added and also dissolved. The pH was adjusted to 9.5 using 50% w/w sodium hydroxide. Sequestering agent mixtures were then added comprising D2066 and DPA (dipyridylamine). For the addition of the sequestering agents, firstly half of the D2066 required was added and subsequently the DPA (if any) was added. Finally, the remaining half of the D2066 was mixed with the peroxide and the peroxide then added to the surfactant mixture and the pH readjusted using the 60% w/v sodium hydroxide solution to give a 5% w/w solution. The quantities of the sequestering agents used are set out as weight percentages of the total formulation in Table 4 below.

TABLE 4

| Formulation | D2066 | DPA |
|---|---|---|
| 3.1 (Control) | 0.1 | 0 |
| 3.2 (Inv'n) | 0.1 | 0.03 |

The percentage AvOx losses after 12 weeks, 26 weeks and 52 weeks storage under accelerated storage (37° C., 80% relative humidity) conditions are given in Table 5.

TABLE 5

| Formulation | % AvOx loss | | |
|---|---|---|---|
| | 12 weeks | 26 weeks | 52 weeks |
| 3.1 (Control) | 69.88 | 100 | N/A |
| 3.2 (Inv'n) | 32.31 | 62.17 | 82.9 |

We claim:

1. A liquid oxidising concentrate composition containing transition metal ions and comprising peroxide and a combination of sequestering agents in an amount which is at least stoichiometric to fully complex all of the transition metal ions, at least one of the sequestrants being a Group A sequestrant which sequesters cobalt ions to form non-catalytic complexes for peroxide decomposition and at least one other sequestrant being a Group B sequestrant which sequesters iron, copper and manganese ions to form non-catalytic complexes for peroxide decomposition, said combination further providing an at least as good a result as the control sequestrant in Test A defined hereinbefore.

2. A composition according to claim 1 in which the Group B sequestering agent comprises a phosphonic acid derivative.

3. A composition according to claim 2 in which the amount of the Group B sequestering agent is in the range 0.005 to 1% by weight.

4. A composition according to claim 1 in which the Group A sequestering agent is a compound having nitrogen electron donor ligands.

5. A composition according to claim 4 in which the Group A sequestering agent comprises dipyridylamine.

6. A composition according to claim 4 in which the Group A sequestering agent comprises 1,2 diaminocyclohexyl tetrakis methylene phosphonic acid or salt thereof.

7. A composition according to claim 4 in which the Group A sequestrant is tridentate nitrogen donor compound.

8. A composition according to claim 4 in which the amount of Group A sequestering agent is at least 0.005% by weight.

9. A composition according to claim 1 which is alkaline.

10. A composition according to claim 1 which comprises a surfactant in an amount of at least 3% by weight.

11. A composition according to claim 1 which additionally comprises one or more of builders, activators, electrolytes, hydrotropes, decoupling polymers, optical brightening agents, enzymes, dyes or fragrances, antiredeposition agents, dye transfer inhibitors as further components of the composition.

12. A composition according to claim 1 which is substantially free of lower alkanols.

13. A composition according to claim 1 which additionally comprises a bleach activator.

14. A method for making the composition according to claim 1 comprising forming a pre-mixture comprising a Group A sequestering agent and a Group B sequestering agent in the desired final amounts and subsequently adding the peroxide to the premixture.

15. A method according to claim 14 in which the group A and group B sequestering agents are added sequentially to the pre-mixture.

16. A composition according to claim 10 in which the amount of surfactant is at least 10%.

17. A composition according to claim 8 in which the Group A sequestrant is a triaza-cycloalkane compound in amount of at least 0.01% and no more than 1% by weight, the Group B sequestrant is a non-cyclic alkylene amino poly(methylene phosphonic acid) or salt thereof in an amount of 0.01 to 1% by weight and the composition is alkaline having a pH of at least 7.5.

18. A composition according to claim 17 in which the triaza-cycloalkane compound is 1,4,7-triaza-cyclononane in an amount no greater than 0.6% the non-cyclic alkylene amino poly(methylene phosphonic acid) or salt is diethylene triamine penta(methylene phosphonic acid) sodium salt in an amount of 0.05 to 0.5% by weight and the pH is at least 8.

19. A method for hard surface cleaning, disinfecting or bleaching which comprises utilizing the composition of claim 1.

20. The method according to claim 19 in which the composition is diluted with water before use.

* * * * *